United States Patent [19]

Wixon et al.

[11] Patent Number: 4,976,185

[45] Date of Patent: Dec. 11, 1990

[54] AMMUNITION FEED

[75] Inventors: Philip A. M. Wixon; Denis K. C. Clarke, both of Wolverhampton, England

[73] Assignee: Lucas Industries Public Limited Company, England

[21] Appl. No.: 365,019

[22] Filed: Jun. 12, 1989

[30] Foreign Application Priority Data

Jun. 17, 1988 [GB] United Kingdom ..... 881449

[51] Int. Cl.[5] ..... F41A 9/04

[52] U.S. Cl. ..... 89/35.01; 89/33.16

[58] Field of Search ..... 89/35.01, 33.14, 33.16, 89/33.25, 33.2, 33.17

[56] References Cited

U.S. PATENT DOCUMENTS

| | | | |
|---|---|---|---|
| 2,335,449 | 11/1943 | Salisbury | 89/35.01 |
| 2,565,527 | 8/1951 | Simpson | 89/33.14 |
| 3,529,509 | 9/1970 | Vuceta | 89/33.16 |
| 3,590,684 | 7/1971 | Gilbert | 89/35.01 |
| 4,026,212 | 5/1977 | Dardick | 89/35.01 |
| 4,762,049 | 8/1988 | Hughes | 89/33.14 |

FOREIGN PATENT DOCUMENTS

| | | | |
|---|---|---|---|
| 20030 | 12/1904 | Australia | 89/33.2 |
| 300800 | 5/1916 | Fed. Rep. of Germany | 89/33.1 |
| 350465 | 7/1937 | Italy | 89/35.01 |
| 112861 | 1/1945 | Sweden | 89/33.25 |
| 306440 | 5/1929 | United Kingdom | 89/33.2 |
| 573751 | 12/1945 | United Kingdom | 89/33.2 |
| 619756 | 3/1949 | United Kingdom | 89/33.25 |

*Primary Examiner*—Harold J. Tudor
*Assistant Examiner*—Stephen Johnson
*Attorney, Agent, or Firm*—Laff, Whitesel, Conte & Saret

[57] ABSTRACT

The invention provides an ammunition feed for an automatic weapon in a helicopter gun turret which is capable of flexing in two planes to accommodate movement of the weapon and rapidly and reliably delivering loosely held rounds. The feed comprises a stranded wire belt, having spindles crimped onto it, which moves in a guide chute. Transverse inverted Vee shape members forming cradles are secured at their midpoints to rollers on the spindles and rounds are trapped and transported between adjacent cradles. The cradles are sufficiently flexible to hold the rounds in position during sharp changes in direction of the feed. A transfer wheel delivers rounds to the breech, the drive for the transfer wheel also driving the cable drive, means being provided to ensure positive drive transmission during gun recoil and further means to stop the feed when firing ceases.

18 Claims, 6 Drawing Sheets

AMMUNITION FEED

This invention relates to ammunition feeds for automatic weapons. In the classic machine gun the individual cartridges are mounted in a belt which is drawn through the breech of the gun by energy derived from the recoil as each shot is fired. In some cases the belt is in the form of clips which are linked by the cartridges themselves, effectively forming a chain which is driven by a powered sprocket, and as they emerge from the breech the cartridges disengage from the clips so that there is no belt to guide away, only a collection of loose clips and empty cartridge cases.

In light machine guns the cartridges are often carried loose in a magazine and urged towards the breech by a powerful spring but this is only suitable for a very limited number of rounds.

Where a belt is used it is reasonably flexible and can be guided to and from the breech through a guide or chute which is of approximately rectangular section but which can include sections curved in both planes, and there may be flexible sections of the guide or chute to accommodate movements of the weapon in relation to the box from which the ammunition is being fed. This is the case in particular in gun turrets or barbettes on aircraft, where the ammunition may be stored in a fixed part of the aircraft whereas the gun or guns in the turret are required to traverse and also move in elevation. Even where the ammunition box is mounted in the turret and therefore moves with it in the traversing movements, there is still the need to accommodate elevation and depression of the weapons.

The classical kind of ammunition employs individual cartridges in which the rounds are mounted, each cartridge being fed laterally into the breech, then the breech is closed, the round fired, the breech opens to extract the empty cartridge and then the cartridge, (still in the belt in the case of an automatic weapon) is moved clear laterally. In recent years increasing use has been given to a different kind of round which remains of unchanged external dimensions after firing; moreover, unlike the conventional rimmed cartridge, it is of substantially uniform cross-section throughout its length.

The aim of the invention is to provide a new form of feed for ammunition, capable of flexing in at least one plane to accommodate movement of the weapon, and able to deliver rounds to the breech of the weapon at high speed in a particularly reliable manner.

According to the invention we propose that an ammunition feed should comprise a cable capable of flexing in two perpendicular planes and moving along approximately the mid point of one wall of a guide chute in which there are transverse bars or similar members secured substantially at their midpoints to the belt and designed to transport along the guide chute loosely held rounds or cartridges by trapping them between successive bars.

Thus unlike a conventional continuous belt feed which has to be pre-loaded with individual rounds, these having to be inserted, for example, individually in slots in the belt, the feed proposed can simply be arranged to move below an open slot in the bottom of a box containing the loosely-stacked rounds, picking them up as it goes past.

Moreover, as the cable itself is capable of flexing in two planes, the chute can follow a path which curves both parallel and perpendicular to the major axis of its cross-section.

The cable may be of a known kind in which a stranded steel wire cable has crimped to it short transverse spindles, some extending in one plane and some in another, each spindle carrying on its ends rollers which co-operate with channels forming a guide for the cable. This guide is distinct from, but mounted on, the main guide chute referred to above.

The feed may be in the form of a continuous closed loop, transporting the live rounds from the ammunition box to the breech of the gun and returning the empty cartridge cases or discharged rounds from the gun. Alternatively the empty cases are ejected from the gun and the feed returns empty. The invention is of particular value for handling the recently developed triangular-section rounds used with open chamber guns, as will become apparent below.

The invention will now be further described by way of example with reference to the accompanying drawings, in which.

Figure 2:
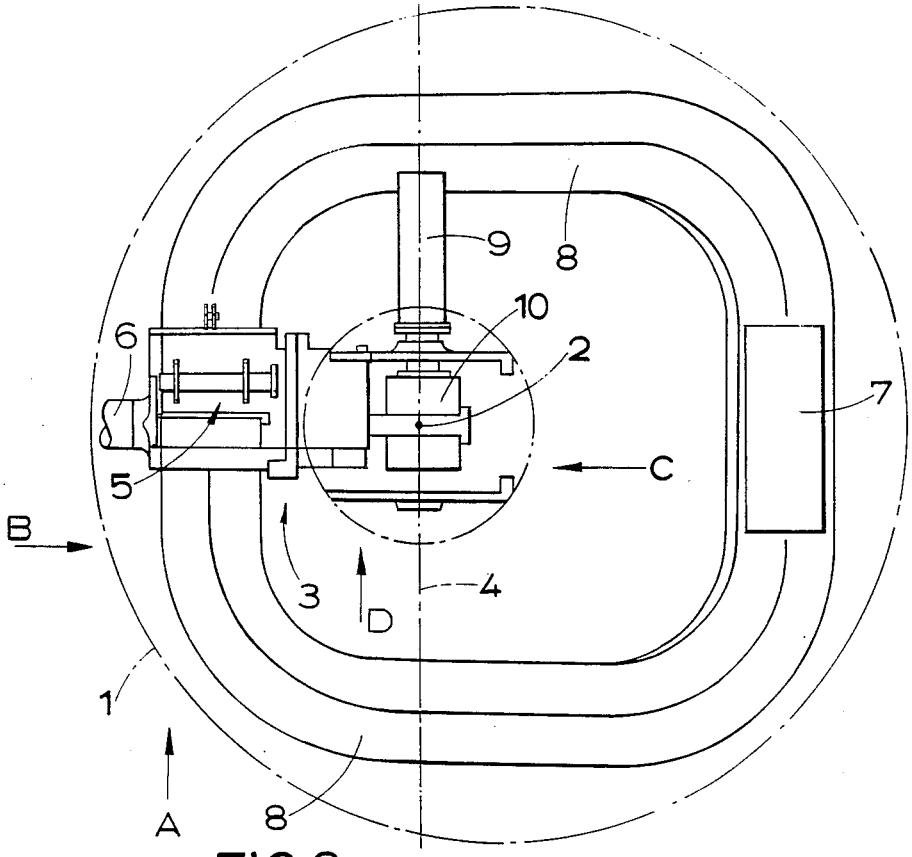
FIG. 2 is a diagrammatic plan view of the ammunition feed, showing its relationship with the supply and with the weapon.

Referring first to FIG. 2, a remotely controlled gun turret or barbette indicated diagrammatically by a broken line 1 is capable of rotating in azimuth about a central vertical axis 2 to traverse the gun 3 which it carries, whilst the gun is itself movable in elevation with respect to the turret about a transverse horizontal axis 4 which intersects the vertical axis 2 about which the turret rotates The breech of the gun is shown at 5 and the barrel (broken away) at 6. The turret illustrated is intended for mounting below the nose of a helicopter or aircraft and so the gun is movable in elevation between a position 5° above the horizontal and 35° below it, in the example shown, although in another version these angles could be different, for example from 18° above the horizontal to as much as 48° below it.

Ammunition for the gun is in the form, of rounds (to be described later) held loosely in a box 7 placed behind the gun on its centre-line. This box is divided by vertical internal walls (not shown) to form a series of compartments, each holding a column of rounds, with a spring-loaded ejector in each compartment to urge the rounds downwards. A guide chute 8 carries a feed which transports the rounds to the breech of the gun on the port side, whilst a continuation of the same chute 8 on the starboard side curves around and returns to the starting point.

Figure 3:
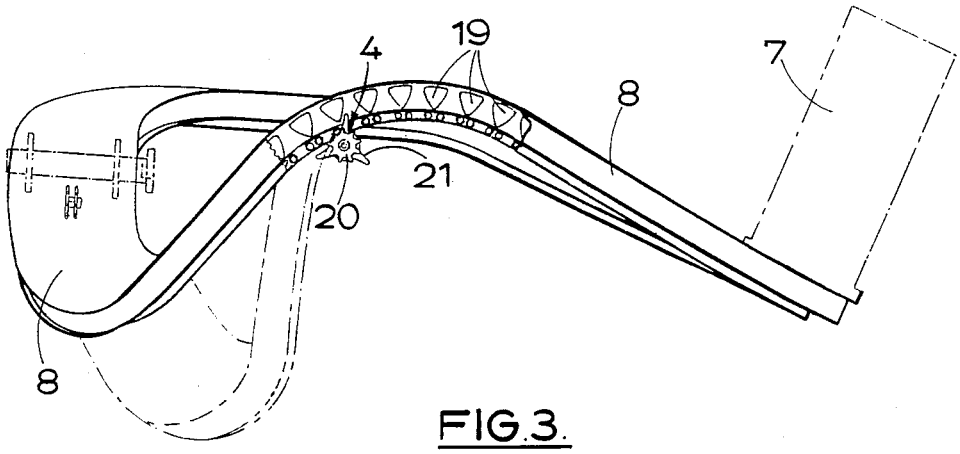
FIG. 3 is a partly cut-away side view looking in the direction of the arrow A in FIG. 2, and showing more detail.

The chute 8 is of generally rigid construction, rectangular in cross-section, but with curves in the plane of the longer axis of the cross-section and, as is apparent from FIGS. 3 and 7, it also curves in a vertical plane, so as to enter the region of the breech of the gun from below and leave it in an upwardly inclined direction.

Although generally rigid, the chute 8 has a hinge in each of its two portions where it passes through the axis 4, to allow for movements of the gun in elevation. Each hinge is on that axis, and the limits of travel of the forward part of the port side (i.e. the delivery side) of the chute are indicated in broken lines in FIG. 3.

An electric motor 9 (FIG. 2) driving through a right-angle drive in a gearbox 10 controls the operation of the gun, as well as the feeding of the rounds to it, in a manner to be described later.

Figure 4:
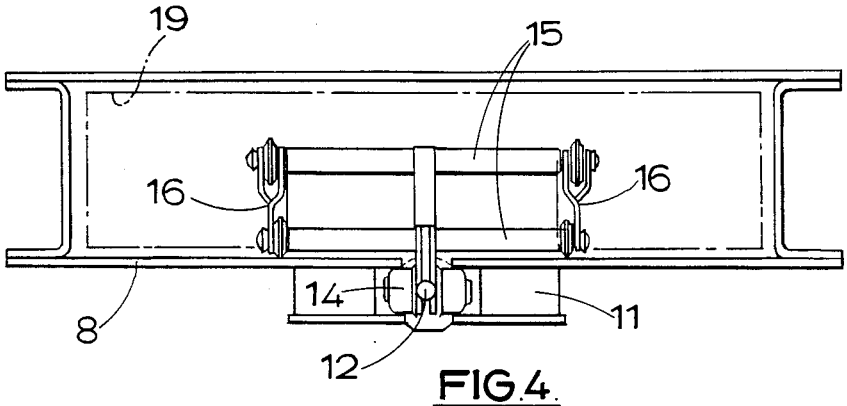
FIG. 4 is a transverse section through the chute to a larger scale, showing the cable and the location of the transverse guide bars and rounds of ammunition.
Figure 5:
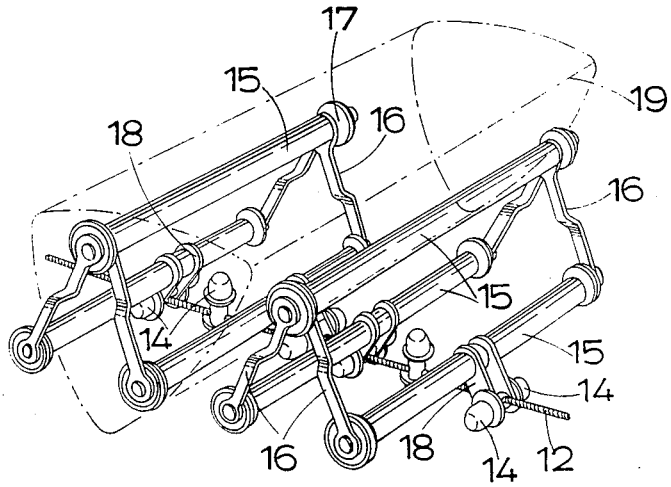
FIG. 5 is an isometric view of a section of the cable and guide bars.
Figure 6:
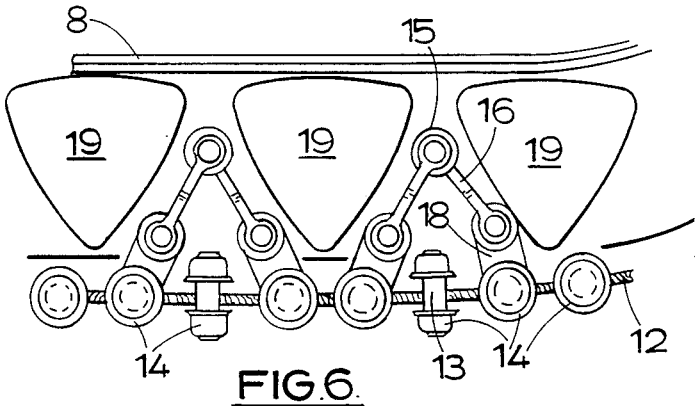
FIG. 6 is a side view of the same section of feed.

We now turn to FIGS. 4, 5 and 6 which show the feed arrangement within the chute. One of the longer sides of the rectangular section of the chute is slotted at its mid point and carries an external guide 11 for a cable of a known kind comprising a stranded steel wire cable 12 onto which are crimped short transverse spindles 13 carrying moulded plastics rollers 14 on both ends. In the normal commercially available cable of this kind the spindles are arranged alternately, but in the cable we use, for reasons which will become clear, there are two horizontal spindles between each adjacent pair of vertical spindles.

Mounted on the cable are cradles or transverse members of inverted Vee form, each comprising three transverse bars 15 joined by end links 16. As best seen in FIGS. 5, 6, each transverse member has an upper transverse element 15 coupled through a number of links 16 to a number of lower transverse elements 15. Taken together, the elements 15 might be described as having a cross-section somewhat in the form of an inverted Vee form or an equilateral triangle. At midpoint 18, the lower transverse elements 15 are secured to the cable 12. In practice each bar is made up of a central rod with a hollow spacer or sleeve rotatably mounted on it. Each end of a link 16 is attached to the end of the rod. Nylon rollers 17 between the adjacent links at each end of the transverse bar 15 forming the apex of the Vee ensure flexibility. Further rollers, which run on the floor of the chuting, are incorporated at each end of each of the two lower transverse bars between the sleeve and the link. The joints between the links and the sleeves and rods are also sufficiently flexible in twisting to allow the necessary movements in two planes. Secured to the midpoint of each of the lower sleeves is a pair of lugs 18 with eyes by which they fit onto a respective one of the horizontal spindles on the cable 12 inside the rollers 14.

The spacing between the two spindles to which a given cradle is secured is such that the cradle forms an approximately equilateral triangle in side view when the cable is straight and the bars 15 are parallel. Between each adjacent pair of cradles there is thus a Vee shaped gap and this receives a round or cartridge, shown at 19.

In the example shown the rounds are of a known curvilinear triangular profile but it will be appreciated that rounds of another profile could equally well be carried, possibly with modification of the shape of the cradles. The important points to note are that the rounds rest loosely in the gaps between the cradles (they project well beyond the cradles at both ends) and that the cable is free to flex in two planes, allowing the rounds to be carried round a curve in the horizontal plane as well as being able to handle changes of direction in a vertical plane, not only the smooth curves of the rigid part of the chute 8, but also, in particular, the sharp transition at the hinge axis 4, especially sharp when the gun is fully depressed. At this point on both the delivery and return parts of the chute there is a pair of idler sprockets 20 (FIG. 3) engaging the rollers on the horizontal spindles 13 of the cable as those spindles pass through the axis 4, which in this example intersects the axis of cable 12, and those sprockets drive spiders 21 of which the legs project between successive rounds 19 clear of the cradles and help those rounds past the sharp change of direction.

On curves in the horizontal plane the cradles are able to change their profile, the angle between the links 16 on given common rod 15 becoming greater at the outside of the curve and smaller at the inside, whilst still guiding and controlling the movement of the individual rigid rounds 19 resting between them. This is because the spacing between the individual bars is fixed only at their midpoints, by the lugs 18 that join them to the cable.

As the cable 12 carries the cradles horizontally below the columns of rounds in the box 7 a loose round is urged downwards through an opening in the floor of the box into each space between two adjacent cradles and is carried along by them; this continues to happen as long as the cable is moving and there are rounds present in the box. Thus, unlike known ammunition belts it requires no manual or mechanical insertion of rounds into slots or pockets beforehand but simply picks them up continuously when needed.

Figure 1:
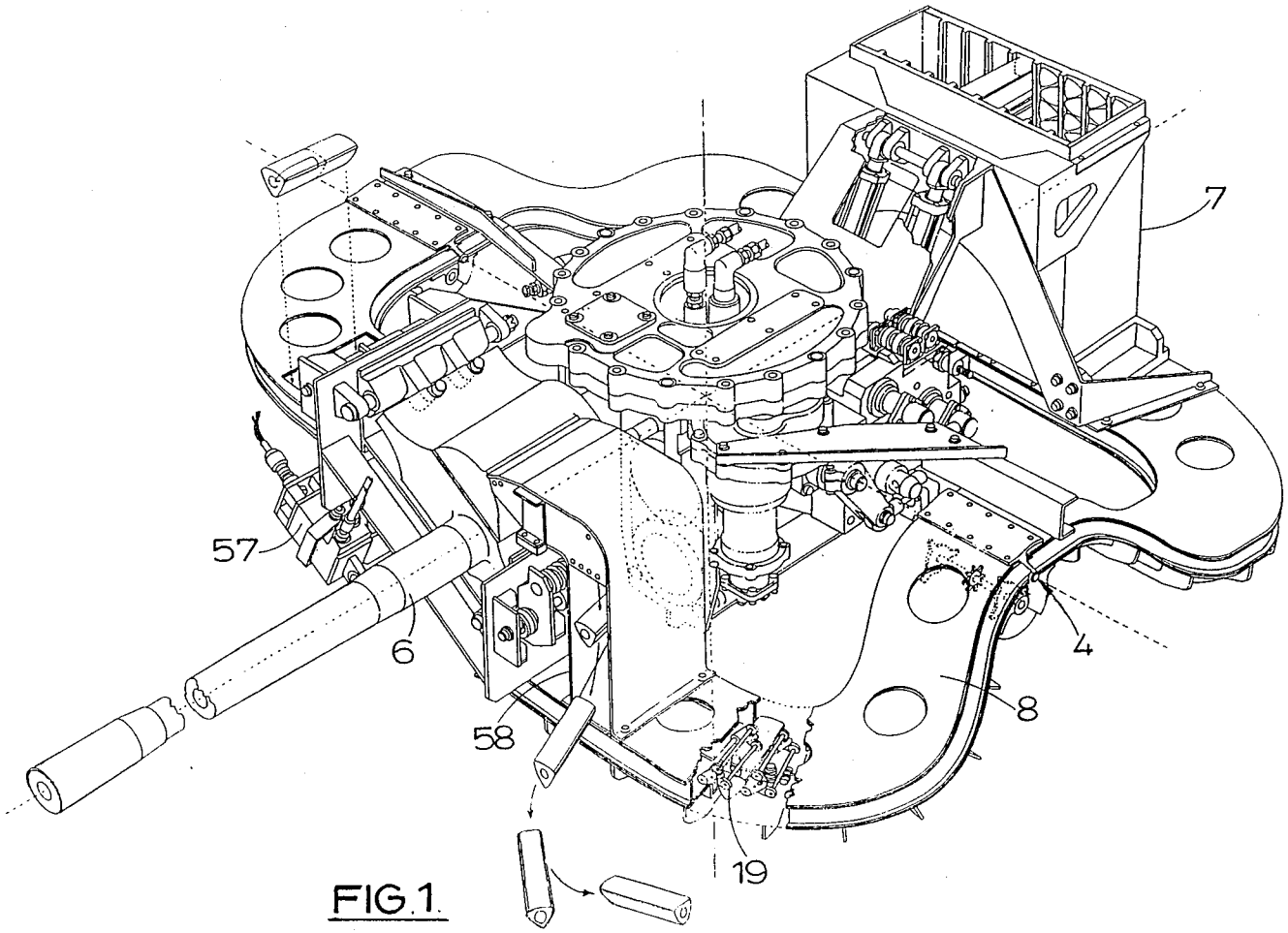
FIG. 1 is a general isometric view showing an embodiment of the invention in use.
Figure 7:
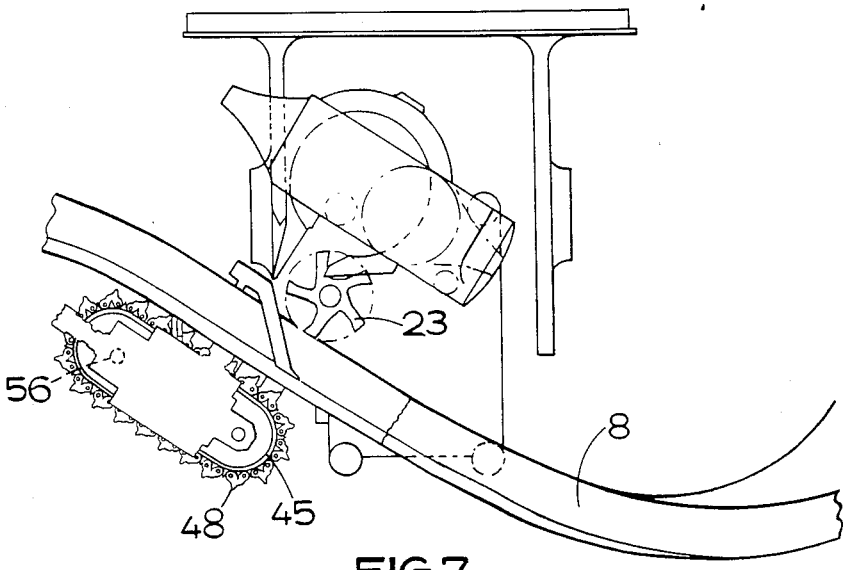
FIG. 7 is a diagrammatic view of the feed to the weapon, looking in the direction of the arrow B in FIG. 2.

We now turn to FIG. 7. As the rounds pass in an upwardly inclined direction below the breech of the gun they are picked out of the chute by a pair of fixed guide ramps 55 spaced apart by a distance greater than the length of the cradles, and enter between pairs of rotary transfer claws which form a transfer wheel 23 and carry them round to feed them into the breech of the gun. As stated earlier, the gun is of the known open chamber type, in which the chambers are formed by grooves in the periphery of a drum or cylinder which is indexed intermittently to carry each round in turn to a position where it is aligned with the barrel of the gun and the open outer wall of the groove is closed by a fixed concave wall. At this point the round is fired and then the spent round is ejected from the breech and either thrown away altogether through a spent-ammunition chute 58 (FIG. 1) or it could be transferred back into the feed chute. Such a gun is capable of a firing rate of 2000 rounds per minute.

Figure 8:
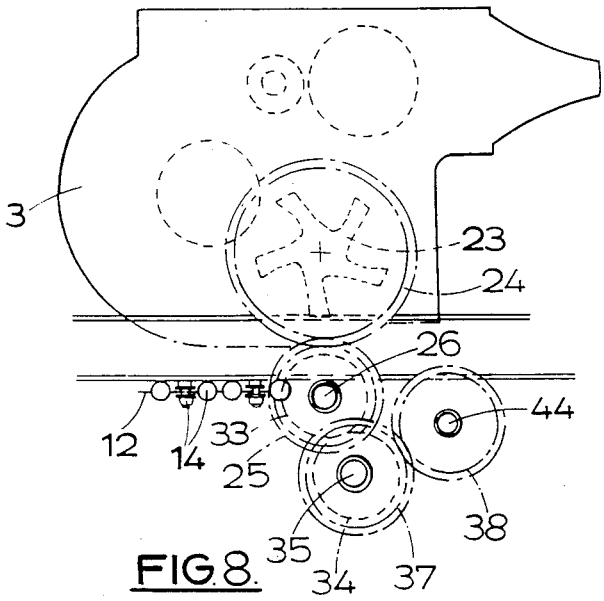
FIG. 8 is a diagrammatic view in the opposite direction, looking in the direction of the arrow C in FIG. 2 and illustrating the mechanical drive to the weapon and the cable.
Figure 9:
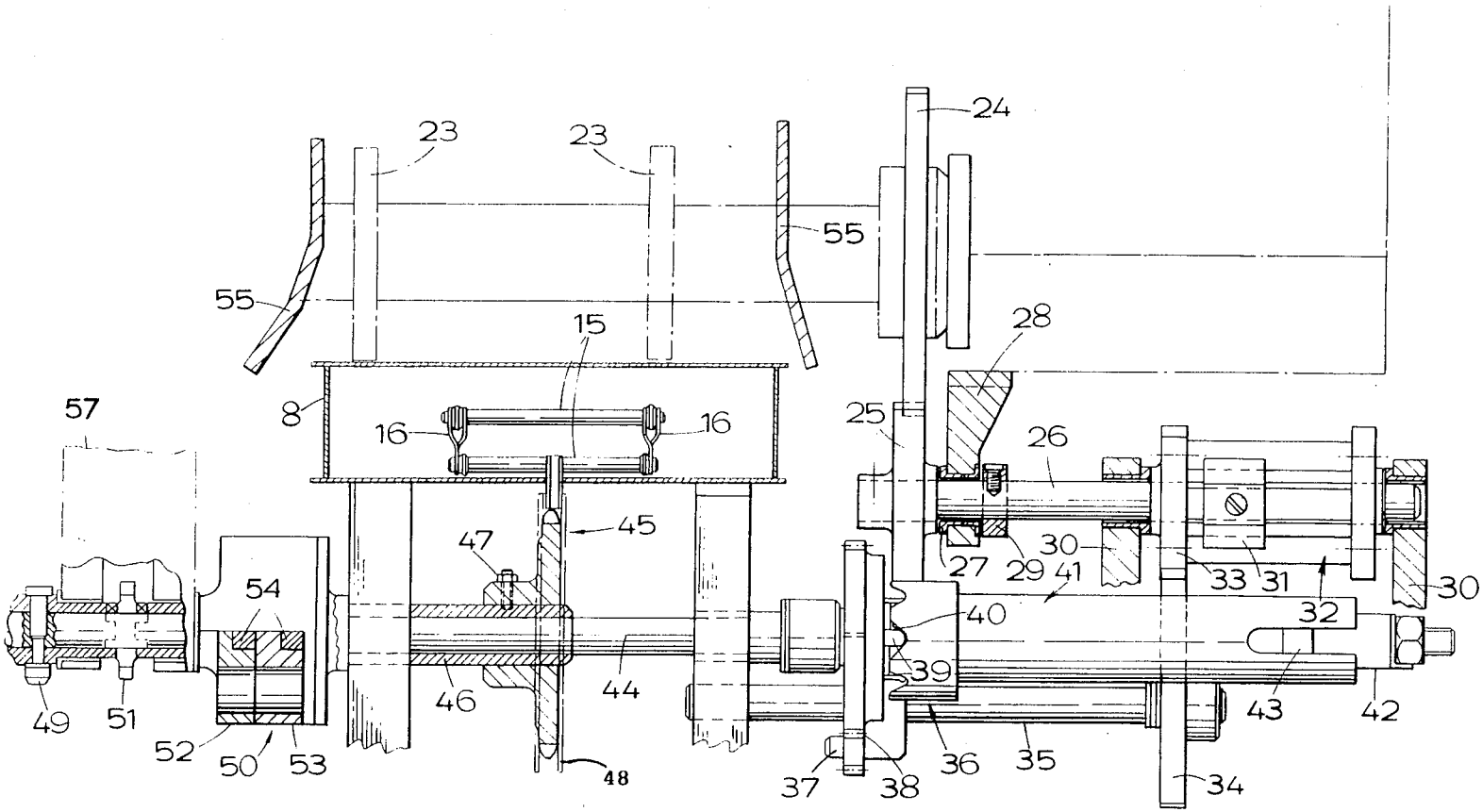
FIG. 9 is a diagrammatic view of the drive looking in the direction of the arrow D in FIG. 2.

The drive for the ammunition feed is shown in FIGS. 8 and 9. A shaft (not shown) driven from the gearbox 10 drives the transfer wheel 23 and carries a gearwheel 24 meshing with a pinion wheel 25 on a primary shaft 26. This shaft is carried in a bearing 27 on bracket 28 mounted on the gun 3 and is axially located with respect to the gun by a collar 29 secured on it.

Now the gun must be allowed to recoil, and this means that the transfer wheel 23, must be able to move with it, together with the motor 9 and gearbox 10. This means that they have to be free to move to the right and to the left as viewed in FIGS. 2 and 9, yet it is necessary to transmit a positive drive to the ammunition feed.

Accordingly the shaft 26 is free to slide axially through spaced bearings in brackets 30 mounted on a fixed part of the turret. A star wheel, or spider, 31 secured on the shaft forms a driver to transmit the drive to a cage 32, formed by four rods, mounted between the brackets, the star wheel being free to slide within the rods allowing relative axial movement. A gear wheel 33 forming the left-hand end of the cage meshes with a gear wheel 34 on a secondary drive shaft 35 which, through an overload release clutch 36 (which may be of a known kind) provides a drive for the cable 12.

In the embodiment shown in FIG. 9 a pinion wheel 37 is fixed to the secondary drive shaft. The clutch 36 comprises a geared component 38, which is free to rotate about a clutch shaft 44 and driven by pinion wheel 37 and has seven pins 39 which are located in indentations 40 in a sleeve assembly 41 during driving motion. The sleeve assembly 41 is biassed towards the geared component and drives a second sleeve 42 by means of a dog 43, the second sleeve being drivingly keyed to the clutch shaft 44. If the clutch shaft drive is rapidly halted while the sleeve assembly can still rotate, the pins 39 cam the sleeve assembly against its bias and out of engagement with the geared component 38.

The cable drive mechanism involves a sprocket 45 mounted on a third sleeve 46 by a shear bolt 47 and driven by the clutch shaft, and an idler sprocket 56 (FIG. 7). A continuous double chain 48 passes over the sprockets and drives the cable belt. To ensure adequate engagement between the chain 48 and the belt the sprockets are located in the region of a 'dip' in the cable belt just after the point where the ammunition has been loaded into the gun. The position of the idler sprocket 56 is adjustable to tension the chain.

The third sleeve 46 is located over the clutch shaft 44, beyond the chain drive sprocket 45, by a shear pin 49 and is dogged to a compliance device 50 which is itself dogged to a seven-notched wheel 51. A roller (not shown) in a housing 57 is urged into contact with the notched wheel 51 by the action of a double acting piston and a spring acting on the piston. When the gun is in use a hydraulic pressure acting on a first side of the piston urges the piston away from the roller against the spring and the notched wheel is free to rotate allowing drive to be imparted to the cable belt. When the gun stops firing a hydraulic pressure is applied to a second side of the piston reinforcing the spring action and pushing the roller into the notched wheel 51 which immediately stops the notched wheel rotating and consequently prevents the clutch shaft 44 rotating.

The compliance device 50 comprises two members 52, 53 dogged together with rubber elements 54 bedded between the dogs to provide a cushioning effect which when the notched wheel is suddenly stopped allows the clutch shaft to continue to rotate by compression of the rubber elements, the drive sprocket 45 advancing the cable belt by up to 12mm further.

Thus the cable, and hence the ammunition feed is positively driven directly from the gun in a manner which still allows the gun to recoil with respect to the feed and the chute. As will be seen in FIG. 8 the claws of transfer wheel 23 (which moves axially with the gun) are placed to allow this. Guides 55 ensure a smooth pick-up of the rounds from the feed into the breech of the gun by the transfer wheel despite the relative movement.

With the gun firing at a rate of 2000 rounds per minute the belt has to move at about 1.25 meters per second. It is desirable that when the pilot releases the firing buttons the feed should cease immediately but the gun should continue firing until the transfer wheel and cylinder are emptied of rounds. Accordingly, when the button is released, a hydraulic pressure is applied to the second side of the double acting piston bringing the roller into engagement with the notched wheel and preventing any further transmission of drive to the sprockets. This brings the feed to a sudden halt.

This is where the overload clutch 36 comes into play. It immediately starts to slip, allowing the drive to the breech of the gun and to the transfer wheel to continue. It continues for approximately 160 milliseconds, by which time the transfer wheel and cylinder are cleared of rounds, and then the motor 9 is halted.

When firing is resumed hydraulic pressure acts on the first side of the piston allowing the roller to disengage from the notched wheel and the feed continues as before.

In a modification the clutch 36 could be incorporated at another point.

Figure 10:
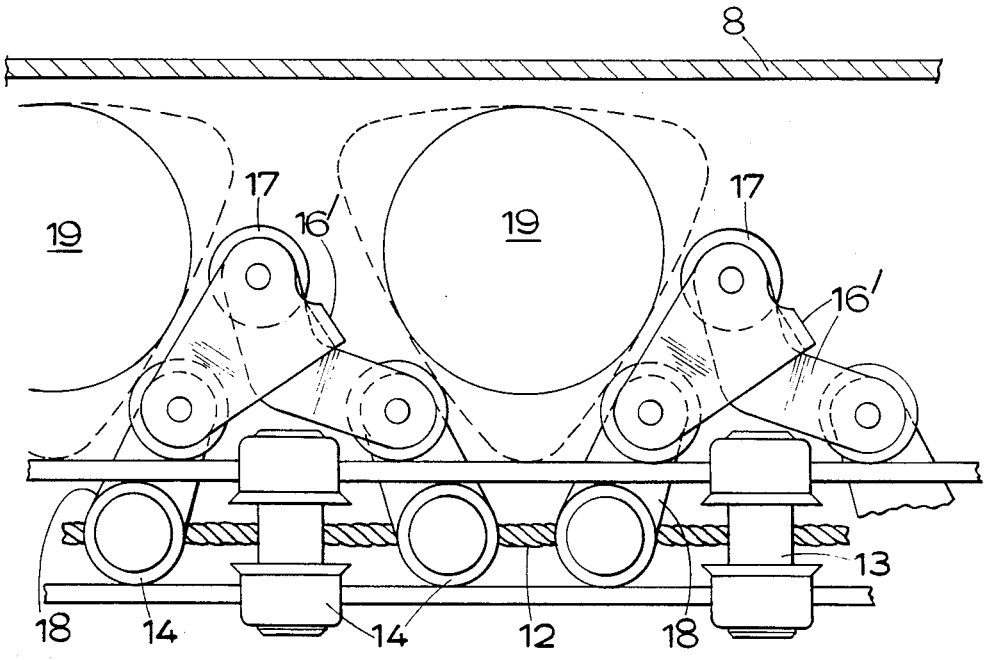
FIG. 10 shows an alternative form of link for supporting the transverse guide bars.

FIG. 10 shows an alternative profile for the links that form the cradles. These modified links, shown at 16' are particularly suited to allow the feed to handle rounds of circular cross-section just as effectively as the triangular ones illustrated.

It will be understood that the feed system described is applicable also to other forms of gun and to other forms of ammunition. The important things are the way the cable is able to flex in two planes yet to carry the rigid rounds in the necessary path at very high speeds without jamming, and to cater if necessary for elevation and other movements of the gun, in particular by providing that the chute hinges about the axis of tilt of the gun without detracting from the smoothness of the travel.

We claim:

1. An ammunition feed for transporting loosely held rounds or cartridges, said feed comprising a cable, a guide chute having first and second walls, each of said walls having a midpoint, said cable being flexible in two perpendicular planes and movable along approximately said midpoint of said first wall and a plurality of transverse members, each of said plurality of transverse member comprising a number of upper transverse elements coupled to a number of lower transverse elements and means for securing a midpoint of each of said lower transverse elements to said cable, said transverse members being spaced successively along said cable such that said rounds or cartridges may be trapped between said successive transverse members along said guide chute.

2. A feed according to claim 1 in which said guide chute follows a path which curves in a horizontal and a vertical plane.

3. A feed according to claim 1, in which said cable comprises a stranded steel wire cable having short transverse spindles crimped thereto, some of said spindles extending in a first plane and some extending in a second another plane, each of said spindles having a first and second end and having rollers on each said first and second end, the rollers of said spindles which are orientated substantially parallel to said walls of said guide chute cooperating with a guide channel mounted on said guide chute.

4. A feed according to claim 1, in which each of said plurality of transverse members is of an inverted Vee form and each of said lower transverse elements comprises two lower transverse bars at the bottom of said inverted Vee form, and each of said upper transverse elements comprises an upper transverse bar at an apex of said inverted Vee form, a pair of end links securing opposite ends of said upper transverse bar with opposite ends of said two lower transverse bars, and rollers being provided between adjacent one of said end links at each end of said upper transverse bar at the apex of said Vee form.

5. A feed according to claim 4, in which each of said lower transverse bars and said upper transverse bar comprises a central rod and a hollow sleeve rotatably mounted on said central rod, pairs of lugs being secured to a midpoint of each of said sleeves of said lower transverse bars, said lugs being arranged to engage a plurality of spindles crimped onto said cable.

6. A feed according to claim 5 in which a spacing between two of said spindles to which a given transverse member of said plurality of transverse members, after the word 'member 'is attached is such that a cross-section of said transverse member forms an approximately equilateral triangle and a spacing between adjacent ones of said transverse members is such that a Vee shaped gap is formed in which one of said rounds or cartridges may be received.

7. A feed according to claim 1, in which said feed is a continuous closed loop transporting ammunition from an ammunition box to a gun breech.

8. A feed according to claim 1, in which said feed moves below an open slot in a box containing loosely stacked rounds, said rounds dropping through said slot and onto said feed, and being held in Vee shaped gaps between adjacent said transverse members and a transfer wheel delivering ammunition from said feed to a gun mounted adjacent to said feed.

9. A feed according to claim 8, in which said cable is driven by a double chain located beyond said transverse wheel.

10. A feed according to claim 9, in which an electric motor drives said transfer wheel and through an overload clutch provides a drive for said double chain.

11. A feed according to claim 10, in which means are provided to ensure that a positive drive is transmitted to said cable whilst allowing said gun to recoil, said means comprising a star wheel, mounted on a shaft providing drive for said transfer wheel, which forms a driver to transmit said drive to a cage which transmits drive to said clutch, said star wheel and said cage allowing relative axial movement whilst ensuring positive transmission of said drive.

12. A feed according to claim 11, in which a means is provided for halting said cable when firing ceases, comprising a notched wheel dogged to a shaft driving said double chain and means for releasably preventing said notched wheel from rotating.

13. A feed according to claim 12, in which a compliance device is mounted a drive chain for said chain between a chain drive means and said notched wheel, said compliance device allowing a slight overrun of said cable.

14. A feed according to claim 13, in which said overload clutch enables said transfer wheel and breech to continue for a short period before said motor stops so as to clear said transfer wheel and breech of ammunition.

15. A feed according to claim 1 in which said transported rounds or cartridges have a substantially triangular cross section ('rounds').

16. A gun turret incorporating an ammunition feed in accordance with claim 1.

17. A helicopter incorporating a gun turret in accordance with claim 16.

18. A helicopter incorporating an ammunition feed in accordance with any one of claims 1 to 15.

* * * * *